United States Patent [19]

Dever

[11] 4,365,689

[45] Dec. 28, 1982

[54] TILTING MARINE LADDER

[76] Inventor: Francis Dever, 8208 Central Ave., Sea Isle City, N.J. 08243

[21] Appl. No.: 232,339

[22] Filed: Feb. 6, 1981

[51] Int. Cl.[3] ..... E06C 1/36

[52] U.S. Cl. ..... 182/97; 182/106; 182/206

[58] Field of Search ..... 182/97, 98, 106, 91, 182/95, 206

[56] References Cited

U.S. PATENT DOCUMENTS

| | | | |
|---|---|---|---|
| 705,042 | 7/1902 | Cowles | 182/86 |
| 712,262 | 10/1902 | Cody | 182/86 |
| 971,276 | 9/1910 | Johnson | 182/98 |
| 1,009,241 | 11/1911 | Halsted | 182/98 |
| 1,140,833 | 5/1915 | Keuling | 182/98 |
| 1,411,438 | 4/1922 | Kalkusch | 182/86 |
| 1,482,117 | 1/1924 | Cowles | 182/98 |
| 2,187,633 | 1/1940 | Smith | 182/206 |
| 2,570,865 | 10/1951 | Sabo | 182/91 |
| 2,721,345 | 10/1955 | Aken | 182/98 |
| 3,052,896 | 9/1962 | Beach | 182/97 |
| 3,285,367 | 11/1966 | Brodie | 182/97 |
| 3,480,107 | 11/1969 | Goodhue | 182/97 |
| 3,539,033 | 11/1970 | Schwarz | 182/77 |
| 3,606,934 | 9/1971 | Johansen | 182/106 |
| 3,973,646 | 8/1976 | Martinez . | |
| 4,067,412 | 1/1978 | Jackson . | |
| 4,146,114 | 3/1979 | Beavers | 182/206 |
| 4,146,941 | 4/1979 | Haslam | 182/91 |

FOREIGN PATENT DOCUMENTS

| | | | |
|---|---|---|---|
| 743995 | 1/1956 | United Kingdom | 182/100 |

OTHER PUBLICATIONS

1973 Marine Catalog—Castle Harbor Ship Chandler, St. Mihiel Drive, Delran, NJ 08075, pp. 92–94.

*Primary Examiner*—Reinaldo P. Machado

*Attorney, Agent, or Firm*—Seidel, Gonda, Goldhammer & Panitch

[57] ABSTRACT

A tiltable, portable, pivotable marine type ladder which is horizontally oriented in its normal position and tiltable to a vertical position by the application of an initial force in the vertical downward direction. The ladder having two parallel struts capable of being secured to a marine structure, such as a floating dock, and having counterweight balances at the top of two support members pivotably connected to the struts. When one exits the ladder, the slight movement of the water activates the ladder such that it reverts to its original horizontal position.

9 Claims, 4 Drawing Figures

FIG. 1
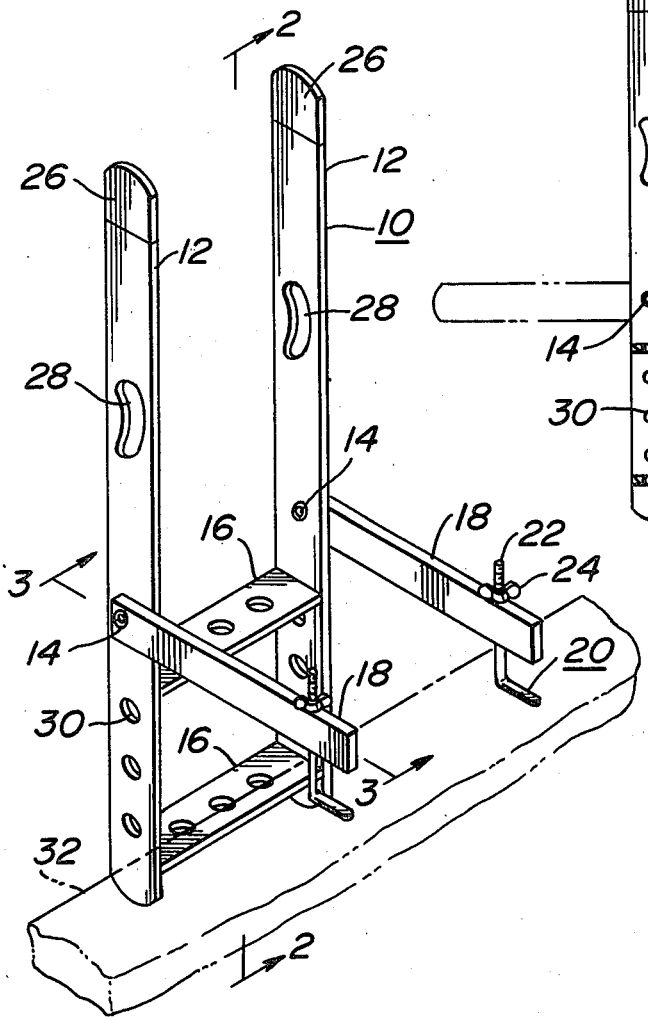
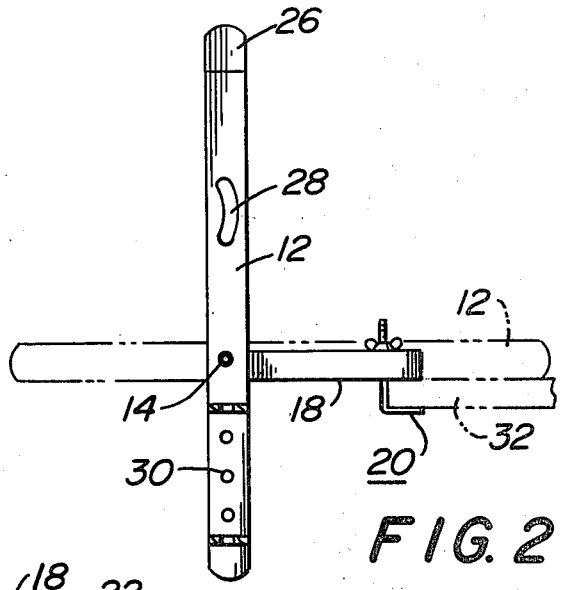
FIG. 2
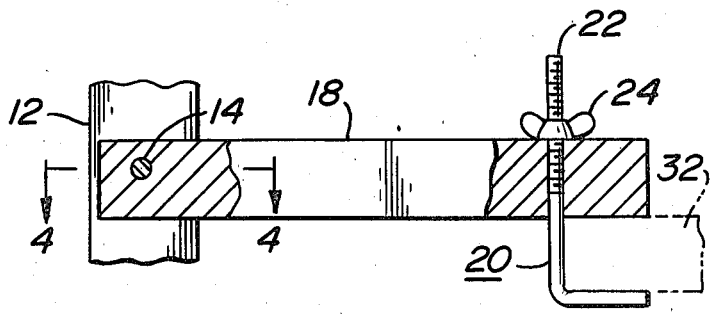
FIG. 3
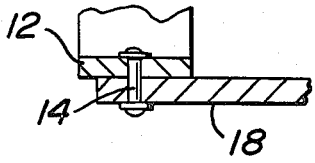
FIG. 4

TILTING MARINE LADDER

BACKGROUND OF THE INVENTION

This invention relates to a tiltable, portable, pivotable marine type ladder. More particularly, this invention concerns a tilting marine type ladder which is normally in a horizontal position out of the water and when a slight amount of vertical force is applied the ladder tilts into a vertical position into the water; on release of such force, the ladder automatically tilts back to its initial horizontal position.

The main use for tilting ladders is derived from their ability to be normally in one position, for example, a horizontal position, when not in use and tiltable to another position, for example, a vertical position, when required for use. Up until the last decade, tilting ladders were generally utilized for fire escapes (see U.S. Pat. Nos. 705,042; 712,262; 971,276; 1,009,241; 1,411,438; 1,482,117) or as balcony type stairs (see U.S. Pat. No. 1,140,833). Fire escape ladders and the like are unsuitable for marine type use due to their large number of stairs and their inability to be positioned in a variety of angles, especially in a vertical position. Fire escapes were generally constructed so that the stairs when released would be at an angle of about 45° from the vertical to assist people in walking from one flight to a flight below.

With the recent utilization of fire-proof construction of high rise buildings, fire escapes are no longer required. A major employment of tilting stairs now is in the marine field as boat, dock and swimming pool ladders.

In the past, many marine type ladders have provided boaters and swimmers with means for climbing from a boat onto a stationary pier or dock. Such ladders have been rigidly secured to the piers, docks, boats or pool sides and therefore they were partially submerged in the water. The lower part of such ladders were subject to marine growth which necessitated periodic maintenance on the ladders. Various types of expensive gang planks and moving ladder devices have been designed to connect boats and docks to alleviate this problem.

In order to overcome the aforementioned problems, some workers in the art have resorted to retractable and movable type marine ladders which require some considerable physical force in order to raise and lower the ladder. (See U.S. Pat. Nos. 3,285,367; 3,539,033; 3,606,934; 3,973,646 and British Patent Specification 743,995). Several conventional marine type ladders are disclosed in the 1973 Marine Catalog, Castle Harbor Ship Chandler, St. Mihiel Drive, Delran, N.J. pp. 92–95.

U.S. Pat. No. 2,721,345 discloses a boat stairs employing counterbalance pull springs 30. The springs serve to substantially counter balance the weight of the stairway 17 in its movement from its operative to its stored position.

U.S. Pat. No. 4,067,412 concerns a floating ladder having a rigid guide assembly for holding a ladder. The ladder has a floating bottom. The guide assembly allows for the vertical movement of the ladder as the water level rises and falls.

Heretofore there has been no marine type ladder that has an initial horizontal position out of the water which upon application of a slight vertical downward force automatically tilts into a vertical position to be submerged in the water and automatically reverts back to its initial position upon release of such force and upon activation by the water.

SUMMARY OF THE INVENTION

There has now been discovered a tiltable, portable, pivotable, marine type ladder. The ladder has two parallel support members having a top end and a bottom end. On each of the support members is a pivot means located approximately midway between the top end and the bottom end of the support members. Connecting the support members at positions between the bottom end thereof and the pivot means are horizontal stairs. Parallel struts are connected to each of the pivot means on the support members. A locking means is attached to the outer ends of each of the struts and the locking means is capable of being secured to a marine structure. The marine structure is adjacent to a body of water. Located above the pivot means on each support member is a counterweight balance. The counterweight balance is of sufficient weight so as to be able to tilt the support members from a horizontal position to a vertical position when an initial vertical downward force is applied to the bottom ends of the support members. In its vertical position, the support members are at least partially submerged in the body of water. The counterweight balance is also of sufficient weight to automatically tilt the support members back to their initial horizontal position out of the water when the force is released upon activation by the water.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is an isometric view of a ladder according to the present invention in its vertical position. In FIG. 1, the ladder is viewed from behind.

FIG. 2 is a section taken along lines 2—2 of FIG. 1 showing a side view of the ladder in its vertical position and in phantom horizontal position.

FIG. 3 is a section taken along lines 3—3 of FIG. 1 showing a side view of one of the parallel struts of the ladder.

FIG. 4 is a section taken along lines 4—4 of FIG. 3 showing the pivot means of the ladder in an overhead view.

DETAILED DESCRIPTION OF THE INVENTION

Referring to the drawings and all of which like parts are designated by like reference numerals, the tilting, pivotable marine type ladder 10 of the present invention is shown. The ladder 10 has two parallel support members 12. Pivot means 14 are located approximately midway on the length of each support member 12. The pivot means 14 generally comprises a rotatable pin within a bore in the side of each of the vertical support members 12.

Stairs 16, located below the pivot means 14, connect the support members 12. The number of stairs 16 is generally dependent on the depth of the water, the height of the marine structure and the variation in the rise and fall of the tide. The number of stairs are generally between about two and about ten depending on the aforementioned factors.

Pivotably connected to each pivot means 14 are parallel struts 18. At the outer end of each of the parallel struts 18 are locking means 20 comprising a locking pin 22 on a wing nut 24. The locking means 20 is capable of being secured to a marine structure 32 such as a dock, floating dock, boat, swimming pool, raft, pier, or any other similar type marine structure. The ladder 10 of the present invention is particularly well suited to be attached to a floating dock. Once locked into place, the locking means can easily be released so as to permit the ladder 10 to be freely moved, e.g. to another position on a floating dock.

At the upper portion, i.e. higher than the pivot means 14, of each support member 12 are counterweight balances 26. Preferably, the counterweight balances 26 are positioned at, or near the top of each of the support members 12. The counterweight balances 26 are of sufficient weight to tilt the support members 12 from a horizontal position to a vertical position when an initial downward force is applied to the bottom ends of the support members or to the ladder structures associated therewith, such as the stairs 16. When in the vertical position, the support members 12 are partially submerged in water, i.e. submerged anywhere from the bottom of the support members 12 to just below the pivot means 14. In the vertical position, the support members 12 and the struts 18 are approximately at right angles to each other. Furthermore, when all external forces are released from the ladder 10 the counterweight balance 26 automatically tilts the ladder 10 back to its initial horizontal position out of the water upon activation by the water. Activation by the water involves any movement such as a wave or ripple which would start the ladder 10 to move back into a horizontal position. Once activated, the counterweight balances 26 effect the completion of the movement.

The counterweight balance 26 can be of any suitable material that supplies the requisite weight. Preferably the counterweight balances 26 are hidden from view by incorporating the counterweight balance material inside the support members 12 such as by using flat washers. The weight of the counterweight balance 26 required depends on several factors. These factors include the length of the support members 12, the exact location of the pivot means 14, the exact location of the counterweight balances 26 on the support members 12 and the weight of the ladder 10.

Parallel hand holes 28 are provided above the pivot means 14 on each support member 12. Balance holes 30 are provided on each support member 12 between one or more pairs of stairs 16.

The action of the ladder 10 thus allows it to remain out of the water unless in use. Therefore no marine deposits are built-up on the ladder such as barnacles, algae, slime growth, or other marine growth. The ladder is also not subject to constant erosion by the salt in ocean water or by chemicals in artificial bodies of water such as swimming pools and lakes.

The ladder 10 can be used, for example, on a floating dock. The support members 12 will remain in a horizontal disposed position out of the water parallel to the dock until a swimmer initially moves the ladder slightly in the vertical position. The support members 12 connected by stairs 16 then tilt into a full vertical position allowing the swimmer to climb-up the stairs 16 to the dock. After the swimmer exits the ladder, the support members 12 automatically revert to their original horizontal position out of the water upon activation by the water.

The ladder of the present invention can be fabricated from any convenient material such as wood, for example, mahogany; plastic; fiberglass; aluminum, etc.

A typical ladder made from ¾ inch mahogany wood is about 5 feet high and 15 inches across having two stairs about 14 inches apart with pivot points located approximately 4 inches below the midway position on the vertical length of the support members. The struts of a typical ladder according to this invention are approximately 15 inches long. The size of the ladder of the present invention is such that it can be freely moved, i.e. portable. Counterweight balances for such ladder would be approximately 3 ounces on each support member.

The present invention may be embodied in other specific forms without departing from the spirit or essential attributes thereof and, accordingly, reference should be made to the appended claims, rather than to the foregoing specification, as indicating the scope of the invention.

I claim:

1. A tiltable, portable, pivotable marine type ladder which comprises:

(a) two parallel support members having a top end and a bottom end;

(b) two pivot means, each of the pivot means disposed on each of the support members at a location approximately midway between the top and the bottom end of the support members;

(c) a plurality of horizontal stairs connecting the support members at positions between the bottom end of the support members and the pivot means;

(d) two parallel struts, each of the struts having a pivotable end and an outer end, the pivotable end of each of the struts pivotable connected to each of the pivot means;

(e) a locking means attached to the outer end of each of the struts and the locking means capable of being secured to a marine structure, said marine structure being adjacent to a body of water;

(f) a counterweight balance located above the pivot means on each of the support members, the counterweight balance being of a sufficient weight so as to be able to tilt the support members from a horizontal position to a vertical position when an initial vertical downward force is applied to the bottom ends of the support members so as to at least partially submerge the support members in the body of water, and also to automatically tilt the support member back to its horizontal position out of the water when the force is released upon activation by said water.

2. The tilting ladder of claim 1 which further comprises one or more pairs of parallel balance holes disposed on each of the support members between two or more of the stairs.

3. The tilting ladder of claim 1 which further comprises a pair of parallel hand holes disposed on each of the support members at a position between the pivots means and the top ends of the support members.

4. The tilting ladder of claim 1 constructed out of wood.

5. The tilting ladder of claim 1 wherein the counterweight balances are located inside the support members so as to be hidden from view.

6. The tilting ladder of claim 5 wherein the counterweight balances comprise flat washers.

7. The tilting ladder of claim 1 wherein the lacking means comprise pin and wing-nut combination.

8. The tilting ladder of claim 1 wherein the marine structure is a floating dock.

9. The tilting ladder of claim 1 wherein said counterweight balances are located at the top of the support members.

* * * * *